United States Patent [19]

Andoh et al.

[11] 4,380,018

[45] Apr. 12, 1983

[54] INK DROPLET PROJECTING DEVICE AND AN INK JET PRINTER

[75] Inventors: Sadanari Andoh; Junji Maeda, both of Kyoto; Kiyoshi Fukushima, Kobe; Hiroichi Yoneda, Neyagawa; Naotomo Jinushi, Hirakata, all of Japan

[73] Assignee: Sanyo Denki Kabushiki Kaisha, Osaka, Japan

[21] Appl. No.: 272,078

[22] Filed: Jun. 10, 1981

[30] Foreign Application Priority Data

| | | | |
|---|---|---|---|
| Jul. 22, 1980 | [JP] | Japan | 55-103727[U] |
| Aug. 11, 1980 | [JP] | Japan | 55-114120[U] |
| Oct. 16, 1980 | [JP] | Japan | 55-145370 |
| Feb. 18, 1981 | [JP] | Japan | 56-23445 |
| Jun. 20, 1981 | [JP] | Japan | 56-84264 |
| Sep. 17, 1981 | [JP] | Japan | 56-132128[U] |

[51] Int. Cl.[3] ..... G01D 15/18

[52] U.S. Cl. ..... 346/140 R

[58] Field of Search ..... 346/75, 140

[56] References Cited

U.S. PATENT DOCUMENTS

| | | | |
|---|---|---|---|
| 3,940,773 | 2/1976 | Mizoguchi et al. | 346/75 X |
| 4,229,751 | 10/1980 | Tamai | 346/140 PD |
| 4,303,927 | 12/1981 | Tsao | 346/75 |

*Primary Examiner*—Donald A. Griffin

*Attorney, Agent, or Firm*—Darby & Darby

[57] ABSTRACT

An on-demand type ink jet printer, and an ink droplet projecting device used in this printer are disclosed. This device operates in the following way: a piezo-electric element transmits the pressure generated by its vibration first to the pressure transmitting medium of a non-solid matter; through this medium, the pressure is transmitted to the passive vibrating means being in contact with the ink to be projected, and facing the orifice through which ink is projected, thereby vibrating this vibrating means, and by the pressure generated by the vibration, ink is projected through the orifice. With such a structure, the assembling work of this device is easy; uniform projection characteristics are achieved, and moreover, the problem of air suction with resultant projection failure is eliminated.

19 Claims, 26 Drawing Figures

INK DROPLET PROJECTING DEVICE AND AN INK JET PRINTER

BACKGROUND OF THE INVENTION (1) Field of the Invention

This invention relates to an ink jet printer for recording patterns of letters, figures, etc., with ink droplets and an ink droplet projecting device used in this printer.

(2) Description of the Prior Art

An ink jet printer, being of non-impact type, has excellent outstanding features including producing low noise, permitting use of common papers as the recording media, and enabling easy realization of color prints and so forth. Such printers presently available for practical use include electric charge control type, electric field control type, on-demand type and ink mist type. This invention relates to the on-demand type ink jet printer which is advantageous in that ink unused for printing need not be withdrawn, that colour printer can be very easily made and that shade of color may be varied by altering the diameter of the ink droplet.

First, the basic constructions of the conventional ink heads are described.

As the conventional ink heads, the single cavity type (U.S. Pat. No. 3,946,398) having an ink cell 91 formed of one compartment which is filled with ink as shown in FIG. 20 and the double cavity type (U.S. Pat. No. 3,747,120) having an ink cell 91 formed of two compartments as shown in FIG. 21 are famous.

The operating principle common to both these types lies in that a piezo-electric element 92 is sinuously vibrated by giving electric signals to the piezo-electric element 92; by this vibration, the pressure inside the ink cell 91 is increased, so that an ink column 94 is projected through an orifice 93 formed in part of the ink cell 91; then, the ink droplet 95 formed by separating from the ink column 94 on account of its own energy and surface tension is let fly toward the recording medium (not shown) which is placed opposite the orifice 93.

In the single cavity type, the projecting velocity of the ink droplet 95 is as low as 2–3 KHz. For this reason, when making the recording at high speeds, use of a plurality of ink heads is required, and scaling-up, increase in the number of parts and fall in reliability are inevitable. Moreover, there are such difficulties that, for example, some contrivance may be required to prevent the weakening of the injection power resulting from inverse transmission of the pressure wave to the ink feeding system 96 for replenishing ink into the ink cell 91, when the piezo-electric element 92 is curved to intrude into the ink cell 91, thereby projecting the ink droplet 95.

On the contrary, in the double cavity type which has the effect of overcoming the difficulty in said single cavity type, a partition plate 98 for separating the ink cell 91 into the compartment **91*a* on the piezo-electric element 92 side and the external compartment 91*b* on the orifice 93 side is necessary, and the coupling aperture 97 bored at the center of this partition plate 98 to communicate these two compartment 91*a* and 91*b* with each other and the orifice 93 and the coupling aperture 97 should be aligned. The minimum resolution for ordinary recording media is said to be, for example, 6 lines/mm in X-Y plotter, etc; in order to meet this condition, the bore of the orifice 93 needs to be of the order of 50 μm, and the inside diameter of the coupling aperture 97** should be on the same order. Thus two holes of the size of the order of 50 μm need to be aligned. This inevitably requires precision work done by use of a microscope. If the alignment between these holes is inaccurate, the desired ink droplet projecting can not be achieved.

Furthermore, the conventional ink heads have a following problem. After the projection of an ink droplet, sometimes air is sucked in through the orifice 93, thereby forming air bubbles because the piezo-electric element 92 curves in the opposite direction to that at the time of projection. Due to the high frequency vibration of the piezo-electric element 92, air dissolved in ink is separated, forming air bubbles. Since such air bubbles absorb the pressure waves produced by the vibration of the piezo-electric element 92, an undesirable phenomenon in which ink droplets are not projected in spite of the vibrations of the piezo-electric element 92 sometimes takes place. The formation of air bubbles resulting from the former reason is particularly prominent in the single cavity type. This drawback is countered by devising such means as orienting to one direction of the fluid resistance of the ink feeding system or increasing the fluid resistance in the counterflow direction of ink. The formation of air bubbles stemming from the latter reason is dealt with by preliminarily reducing the dissolved air by way of adding oxygen absorber to ink or subjecting ink to a defoaming treatment, as disclosed in Japanese Patent Publication No. 20882 of Showa 53 (1978). Whichever method is ineffective to get rid of air absorbed by the ink cell due to an impact force independent of the recording operation applied on the ink head for some reason.

OBJECTS AND BRIEF SUMMARY OF THE INVENTION

The present invention was intended to solve various problems of the prior art as above-described.

The first object of this invention is to provide an ink projecting device which affords easy assembling work, shows uniform projection characteristic, involves little possibility of sucking in air, and is hardly vulnerable to such air bubbles, even if produced, by adopting a structure for indirectly transmitting the vibration of a vibrator to the layer of ink to be projected, and an ink jet printer incorporating such a device.

The second object of this invention is to provide an ink droplet projecting device which enables ink droplets to be projected at high efficiency, and achieving high typographical quality, by ingeniously designing the dimensions and configurations of the orifice and its periphery, and an ink jet printer incorporating this device.

The third object of this invention is to provide an ink droplet projecting device of a construction in which the ink layer and the pressure transmitting medium layer that transmits the vibration of the piezo-electric element, the said two layers being placed on both sides of the passive vibrating means, are communicated in such a way that the vibration of the passive vibrating means which directly gives the pressure waves to the ink layer is not affected thereby, and an ink jet printer utilizing this device.

The above and further objects and novel features of the invention will more fully be apparent from the following detailed description when the same is read in connection with the accompanying drawings.

DETAILED DESCRIPTION OF THE INVENTION

Figure 1:
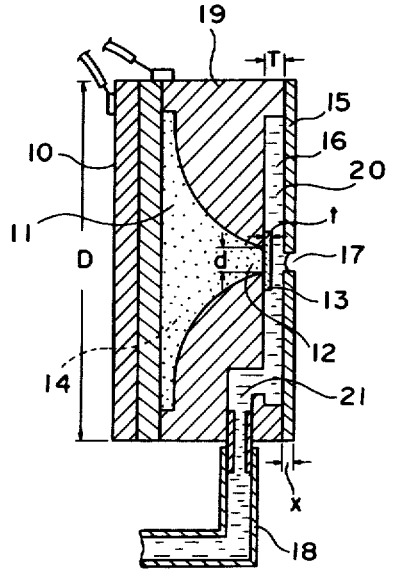
FIG. 1 is a longitudinal sectional view of an ink droplet projecting device of this invention.

First the basic construction of the ink droplet projecting device or the ink head of this invention is described in reference to FIG. 1. In this figure, 19 denotes main body of the head made of stainless steel being in the shape of a cylinder short in its axial direction, and having at its center a horn shape cavity formed as the pressure cell 11. This pressure cell 11 has a small opening on the front side (the ink droplet projecting side) of the main body 19 and a large opening on the rear side. These openings are both circular in shape. The pressure cell 11 is formed symmetrically to the imaginary axis connecting the centers of the front and the rear openings or to the central axis of the main body 19. While the opening 12 on the front side of the pressure cell 11 has the diameter d of the order of 2 mm, the rear side opening has a diameter approaching the diameter D of the main body 19, e.g. 10 mm. The sectional profile of the circumferential surface of the pressure cell 11 is hyperbolic, thus having diminishing diameters from the rear side toward the front side.

On the rear side of the main body 19, or the end of the pressure cell 11 on its large diameter opening side, there is provided to cover this opening a unimorphic type piezo-electric element 10 having the same diameter as that of the main body 19, which is formed by cementing a metal plate on a piezo-electric ceramic plate. The piezo-electric element 10 is used as the pressure generating means, which, as well known, makes vibrations in response to electrical signals in the form of sinusoidal wave, etc., thereby giving pressures to the transmission medium 14 filled in the pressure cell 11. In this pressure cell 11, a transmission medium 14 which affords high rate of transmission of vibration, and which shows damping effect against the residual vibration of the piezo-electric element 10, is filled. For this medium 14, appropriate choice is made from among liquids such as water, ink, silicon oil, mercury, etc., viscoelastic materials such as silicon grease, etc., and colloidal mixtures of powders in liquids such as magnetic fluids, etc.

The front side of the pressure cell 11, that is, the smaller diameter opening of the pressure cell 11 is closed with such a sheet 13 as metal sheet, resin sheet, rubber sheet, film, etc.

Because of this construction, the pressure produced by the vibration of the piezo-electric element 10 is transmitted to the thin plate 13 through the transmission medium 14 inside the pressure cell, as a result, the said sheet 13 is vibrated due to this pressure, and function as a passive vibrating means by giving the pressure to the ink layer 16, thereby projecting the ink droplet.

On the front circumferential resin of the main body 19, a stepped part is formed, and by making use of the front of this stepped part, the front plate 15 is held, forming an ink sump 20 in the narrow gap between the front plate 15 and the main body 19 or the sheet 13. Then through a capillery tube 18 coupled to the ink feeding port 21 bored in the main body 19 for the communication with the said ink sump 20, ink is fed to this ink sump 20, to be held there as an ink layer 16. An orifice 17 of a very small diameter of the order of 50 $\mu m\phi$ is opened in the front plate at the central part opposing the sheet 13.

In the following, the operation of the ink droplet projecting device of this invention having the construction as described hereabove is described in reference to FIGS. 2(*a*)–(*d*), showing, in enlarged views, the sheet 13 and the perimeter of the orifice 17.

(a) of these figures shows the initial state of this device when no electric signal is provided to the piezo-electric element 10. In this state, the sheet 13 is held flat, and the ink in the orifice 17 is slightly curved inwardly under the atmospheric pressure. When a sinusoidal wave form electric signal is impressed on the piezo-electric element 10 in this state, first, during the process in which the phase of the said sinusoidal wave advances from $0\text{-}\pi/2$, the piezo-electric element 10 vibrates by bulging outward (rearward), producing a negative pressure in the pressure cell 11, causing the sheet 13 to bulge toward the pressure cell 11 side as shown in FIG. 2(*b*). At this time, the ink in the orifice is sucked to the ink layer 16 side, but the amount is so small that air is not sucked in therethrough. Then as the phase advances through $\pi/2\text{-}\pi\text{-}3\pi/2$, the piezo-electric element 10 returns from its state of being bulged outward to its state before the electric signal is impressed thereon and then, further greatly vibrates by bulging to the internal pressure cell 11 side. This vibration is transmitted to the sheet 13 placed on the smaller diameter opening through the transmission medium 14 filled in the horn shape pressure cell 11. Thus the pressure cell 11 is in a horn shape having gradually diminishing inside diameters from the side where the piezo-electric element 10 is mounted toward the sheet 13 side. For this reason, the vibration of the piezo-electric element 10 is amplified as it approaches the sheet 13 to be concentrically imposed on the said sheet 13. Accordingly, the pressure cell 11 acts as a pressure amplifier for amplifying the amount of vibration of the piezo-electric element 10 by squeezing the vibration toward smaller areas. Referring to FIG. 2(*c*), by the vibration of the piezo-electric element 10 amplified in pressure, the sheet 13 is greatly sinuously vibrated to the ink layer 16 side, thereby pressing the ink in the neighborhood of the said sheet 13 toward the orifice 17 side, causing an ink column 22 to be extruded through said orifice 17.

Figure 2:
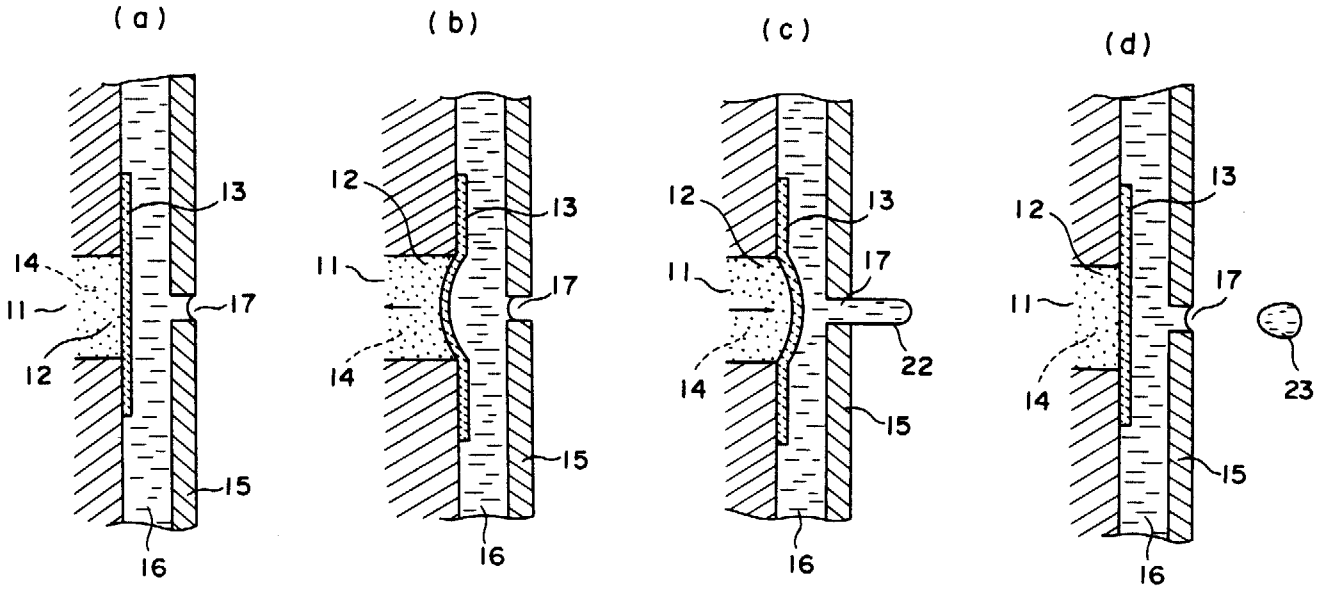
FIG. 2(*a*)–(*d*) are views of explanation of this ink droplet projecting operation.

Finally, in the last process from $3\pi/2$ reaching $2\pi$, the piezo-electric element 10 returns to its initial state; then, the pressure cell 11 has a negative pressure, and the sheet is thereby brought back to its flat state as shown in FIG. 2(*d*). Accordingly, the ink column 22 protruding through the orifice 17 is to be sucked in toward the ink layer 16 side, but its tip part is reversed as an ink droplet 23 due to the kinetic energy exerted in the opposite direction to that of its sucking-in and to its surface tension, and this ink droplet flies out. The number of ink droplets 23 produced is one droplet when the piezo-electric element operates in the low frequency range of the order of approximately 3 KHz and increases to 2–3 droplets, depending on its vibration frequency and amplitude, etc.

Figure 21:
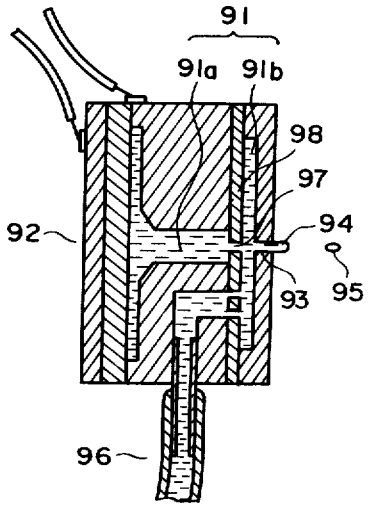
FIG. 21 is a longitudinal sectional view of an ink head of the conventional double cavity type.

Now compairing the ink droplet projecting device of this invention composed as hereabove described and designed to make the ink droplet projecting operation with the double cavity type shown in FIG. 21, in the double cavity type, the diaphragm 98 does not vibrate, and it has a coupling aperture 97 opened therethrough; on the contrary, in the device of this invention, no hole is opened in the sheet 13 placed at a position corresponding to the diaphragm 98, as related to the orifice through which ink is projected; and what is important is that unlike the diaphragm 98, this sheet 13 vibrates in response to the vibration of the piezo-electric element 10, and it is this sheet 13 disposed in the vicinity of the orifice 17 that directly applies the pressure on the ink layer 16. For this reason, in attaching the front plate 15 in the device of this invention, it is only necessary to align roughly the orifice preliminarily opened in the front plate 15 to the central part of the sheet 13 which is adequately larger than the orifice 17. In that way, nearly a constant projection characteristic is achieved, without variation among individual products. As a consequence, the precise alignment between the coupling aperture 97 and the orifice 93 which has hitherto been required is unnecessary, resulting in marked improvement in the workability and better stable quality. Since the sheet 13 has a quite smaller area as compared with the ink layer 16, the possibility of separating the air dissolved in the ink layer by the vibration of the sheet 13 and that of sucking in air through the orifice 17 are nearly eliminated. Because the ink layer 16 is thin, air sucking-in by an impact while out of projecting operation hardly takes place. Even if some air bubbles intrude into the ink layer 16 through the orifice 17 for some reason, the sheet 13 vibrates at a position very near to the orifice 17, applying concentric pressure on the ink containing air bubbles in the vicinity of the orifice, so that they tend to be expelled through the orifice without mingling into the ink layer. So long as the transmission medium 14 put in the pressure cell 11 is subjected to an appropriate pretreatment, and is filled in the pressure cell 11 without allowing air bubbles to be mingled thereinto, the air bubble problem may be entirely forestalled where the use of this medium is concerned.

The following is an example of concrete specification of the device shown in FIG. 1. The diameter D of the main body 19, the piezoelectric element 10 and the front plate 15 were all chosen to be 10 mm, the diameter d of the front side opening of the main body 19, 2 mm, and the thickness T of the ink sump 20, thus, that of the ink layer 16, 300 μm. For the piezo-electric element 10, the unimorphic type employing a lead titanate-zirconate base piezo-electric ceramic plate was used, and as the sheet 13, a 50 μm thick stainless steel foil was utilized. Water used as the transmission medium 14 was put in the pressure cell 11 after its rear side opening was sealed with the piezo-electric element 10, and thereafter, its front side opening was sealed with the sheet 13.

With the use of a device constructed to the above-mentioned specifications, the desirable ink droplet projection was achieved by applying a sinusoidal wave with 20 KHz frequency and 90 V amplitude. As a comparison is made between this device and the conventional device under conditions made identical so far as practicable, the dots drawn with the device of this invention have smaller diameters than those obtained with the conventional device, thus enabling the pattern recording to be made at a higher resolution.

This is probably because in the conventional device, the ink pushed out from the internal compartment 91*a* of the ink cell 91 through the coupling aperture 97 and injected into the external compartment 91*b* drags in the ink existing in the neighborhood of the orifice 93, and it is projected through the orifice accompanied by the dragged-in ink; accordingly, its quantity is large, producing larger dots than those obtained with the device of this invention.

The present inventors made a little detailed study on the dimensional specifications of the orifice 17 and the sheet 13. As described hereabove, the minimum resolution on the recording medium is to be designed at 6 lines/mm. As water-based ink is employed with consideration of viscosity, a highly hygroscopic paper is used for the recording medium. Accordingly, the ink droplets reaching the recording medium stick on the recording medium, enlarged to about twice or thrice the opening diameter of the orifice 17. On this ground, the orifice diameter is generally selected to be on the order of 50 μm. However, since the ink dots produced with the device of this invention are smaller than those from the conventional device, the orifice diameter may be set larger than 50 μm, and in the device of this invention, unlike the conventional device, precise alignment of the orifice and the coupling aperture is not required; then, smaller orifice diameter than 50 μm poses no trouble. Preferable orifice diameter should be specified in the range of 40–60 μm.

Figure 3:
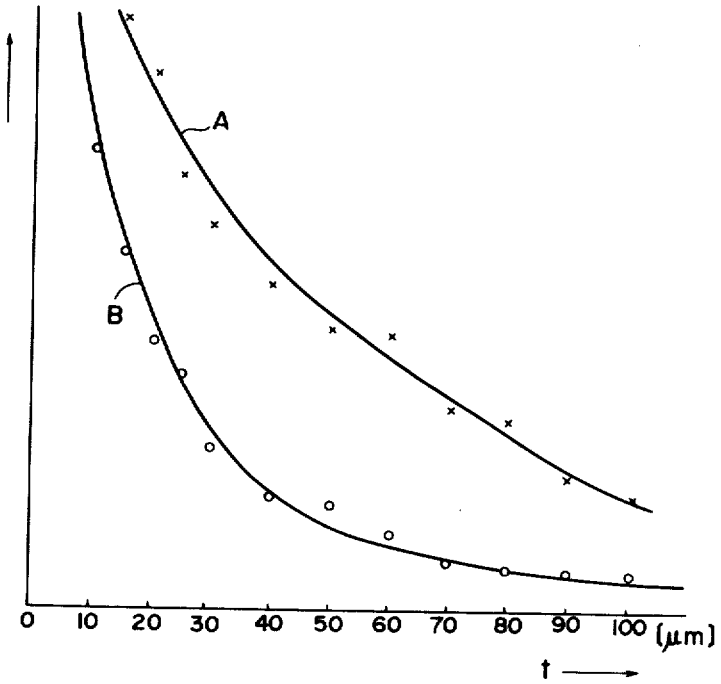
FIG. 3 is a graph showing the relationship between the thickness of the sheet and the amplitude.

Thus it has become clarified by the studies of the present inventors that the dimensions of the sheet 13 as the passive vibrating means, particularly its thickness and the substantial diameter of its vibrating part, that is, the diameter of the front side opening 12 of the pressure cell 11, have a large bearing on the recording quality. Thus FIG. 3 portrays the results of actual measurements of the relationship between the thickness (abscissa) of the sheet 13 and the amplitude (ordinate) when d=2 mm, the curve (A) representing the main vibration, and the curve (B) the residual vibration, respectively. This graph clearly indicates that in both the main vibration and the residual vibration, the thinner the thickness t of the sheet, the larger vibration it will produce, and thicker sheet will produce smaller amplitude. Accordingly, although the main vibration is desired to be large, larger main vibrations produced by decreasing t will result in large residual vibrations, causing unnecessary ink droplet projection due to the residual vibrations. Accordingly, the thickness of the sheet 13 should have a lower limit as well as an upper limit for ensuring proper amplitude of the main vibration.

Figure 4:
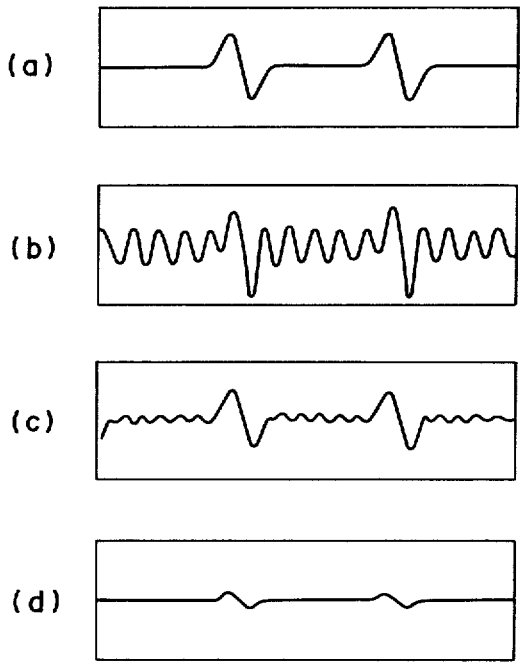
FIG. 4(*a*)–(*d*) are wave form graphs showing the results of an experiment for determining the upper and lower limits of the thickness of the sheet.

FIG. 4 shows part of the experiment conducted for determining these limits, FIG. 4(*a*) representing the wave form of the voltage impressed on the piezo-electric element 10. Thus a sinusoidal wave voltage (50 μs per one cycle) with a 200 V peak to peak amplitude was applied intermittently. FIGS. 4 (*b*), (*c*) and (*d*) delineate graphic representations of vibrations of the sheet 13 with t=30 μm, 50 μm, and 80 μm, respectively, the vibrations appearing at definite positions along the time axis corresponding to the impressed sinusoidal wave voltage being the main vibrations, and the others being the residual vibrations. The peak to peak amplitudes of the main vibrations respectively for t=30 , 50 and 80 μm are respectively 9 μm, 3 μm and 1.5 μm. Since at t=30 μm, the amplitude of the residual vibration reaches the permissible upper limit, thus this value represents its lower limit value, while t=80 μm is the upper limit value, because at such t value, the amplitude of the main vibration shows the permissible minimum value. Nearly the same characteristic was applicable for a range of d=2 mm±1 mm. Then the conclusion was finally drawn that it is desirable to set the orifice opening diameter at 40–60 μm, the diameter of the substantial vibrating part of the sheet being the passive vibration means at 1–3 mm, and its thickness at 30–80 μm.

Figure 5:
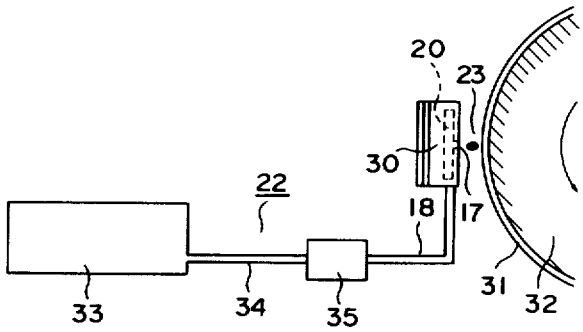
FIG. 5 is a diagrammatic representation of an jet printer of this invention.

FIG. 5 portrays a schematic diagram of an on-demand type ink jet printer employing the ink droplet projecting device of the ink head hereabove-described. 30 denotes the aforementioned ink head, that is held face to face with the rotary drum 32 on which the recording medium 31, e.g., ordinary paper, etc., is wound at a flying distance for ink droplets of about 2–5 mm therefrom. A replaceable ink-cartridge 33 filled with ink is communicated with the ink sump 20 in the ink head 30 through capillery tubes 34 and 18, with an ink connector 35 with a small capacity, containing filters interposed between the capillery tubes 34 and 18. With this construction of the device, as electric signals of the order of 20 KHz are impressed on the afore-mentioned piezo-electric element, ink droplets 23 will be projected through the orifice 17, reaching to the recording medium, which is being rotated and scanned, after a flight of 2–5 mm, then forming the ink dots thereon.

Figure 6:
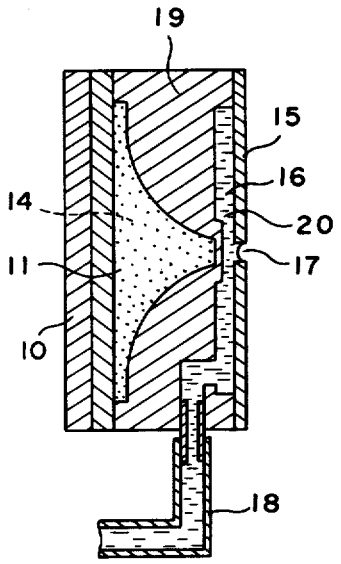
FIGS. 6, 7, 8 and 9 are longitudinal sectional views of other embodiments of the ink droplet projecting device of this invention.

In the following, another embodiment of the ink droplet projecting device of this invention is described. In the device of FIG. 6, the passive vibrating means is formed with part of the main body 19. The front side of the pressure cell 11 is not bored when forming the cell, but the part to be used as the passive vibrating means is made thin by cutting, grinding, etc. The device of this embodiment requires long time for the working, but is free from the fear of the sheet 13 being stripped off.

Figure 7:
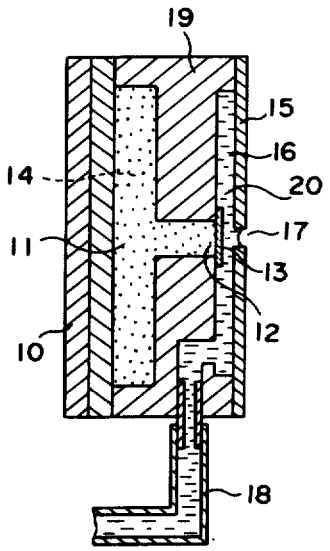

In the device of FIG. 7, the pressure cell 11 is formed in the stepped circular cylinder, having a larger diameter on the piezo-electric element 10 side and a smaller diameter on the sheet 13 side.

As is understood from this embodiment, the pressure cell 11 is not limited to the horn shape, but whatever shape is effective for amplifying and transmitting the vibration of the piezo-electric element 10 to the passive vibration means is usable.

Figure 8:
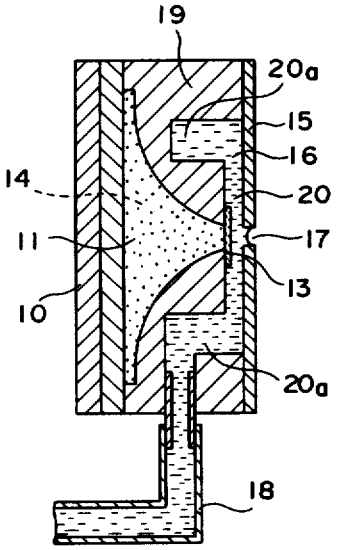

In the device of FIG. 8, the ink sump 20 is so formed as to have an annular groove 20*a* on the periphery like the ink head of Japanese Patent Application Publication No. 10253 of Showa 54 (1979), said groove 20*a* being deeper than the thickness of the ink layer around the sheet 13. By adopting this structure the stabilization of ink droplet projection can be achieved.

Figure 9:
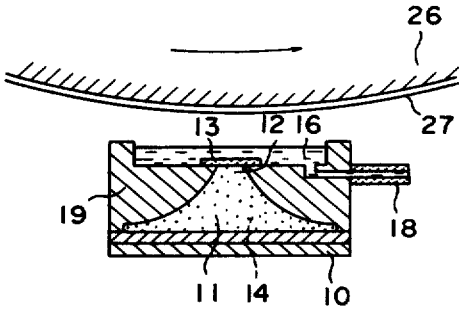

FIG. 9 shows a modified embodiment being in a horizontal posture with the sheet 13 placed on the upper side, and in which the front plate 15 is omitted. The reason is because it is possible to keep the thickness of the ink layer 16 uniform without using its front plate 15, and moreover, it is possible to make projection of ink droplets with the specified diameter in spite of the absence of the orifice 17. This set-up requires no front plate, permitting that much easier fabrication of the device. Furthermore, a device without the front plate 15 may be usable in vertical posture, but such device needs to be properly composed through ingenious design of the main body 19, so that the ink layer 16 will not be stripped off by utilizing its surface tension.

Figure 10:
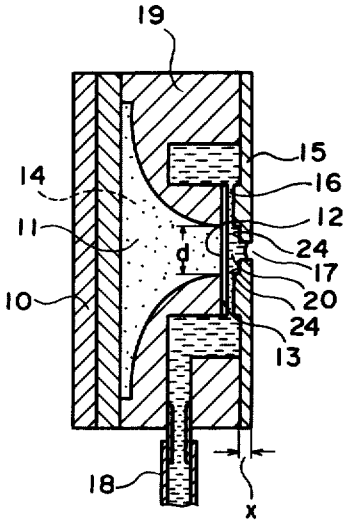
FIGS. 10 and 11 are longitudinal sectional views of embodiments in each of which a recess is formed on the perimeter of the orifice.
Figure 11:
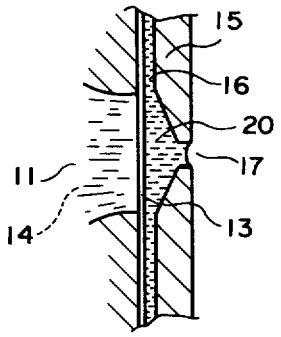
Figure 12:
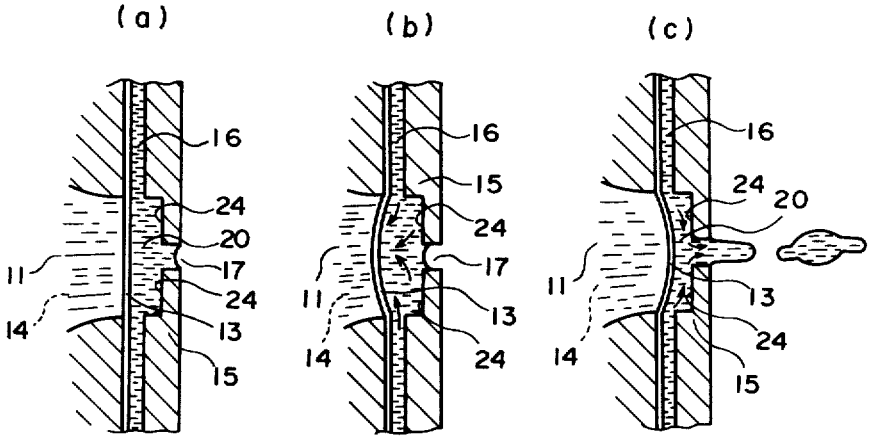
FIGS. 12(*a*)–(*c*) are views for explanation of the operation of the embodiments shown in FIG. 10.

In the following, other embodiments are described with reference to FIGS. 10–12. These embodiments are characterized by the recess 24 formed on the perimeter of the orifice 17 on the inside surface side of the front plate 15, the configurations of the recess including as shown in FIGS. 10 and 12, that having a concentric circumferential surface normal to the sheet 13 and that being conical and concentric to the orifice 17 with its diameter diminishing toward the orifice, as shown in FIG. 11.

The structures of these embodiments are actually beneficial in effectively contributing the vibration of the sheet 13 to the projection of the ink droplets. Since the thickness gives a resistance of the front plate 15 in which the orifice 17 is opened to the ink column which passes through the orifice 17, its thickness is required to be thin, but it cannot be made thinner than a certain degree because of the need to avoid its resonance. That is to say, there is a possibility of causing inability of effective projection or of becoming unstable due to the resonance.

In this regard, according to this embodiment, effective projection is achieved by making thin the part that has relevance to resistance to the projection of the ink column by providing the recess 24, and the area excluding that part, at least the part on the perimeter of the said recess 24, is made thick for avoidance of resonance. In that way, it becomes possible to make stable and efficient ink droplet projection.

The diameter of this recess 24 on the sheet 13 side should be chosen to be on the same order as the diameter of the substantial vibrating part of the sheet 13, i.e., the diameter d of the opening 12 of the pressure cell 11.

Since what is important in substantially regulating the size of the ink droplet is the diameter of the orifice 17, or the diameter of the front side opening of the front plate 15, the diameter of the orifice 17 should be chosen 40–60 μm as hereabove described, irrespective of the presence of the recess 24. Furthermore, the angle of inclination of the conical recess 24 shown in FIG. 11 should be chosen in the range of 30–60 degrees to the central line of the orifice 17.

The ink droplet projecting mechanism in the device of said embodiment which is provided with a recess 24 of the structure shown in FIG. 10 is described hereunder in reference to FIGS. 12 (*a*)–(*c*):

First, in the initial state when the electric signal is not given to the piezo-electric element 10, the sheet 13 is maintained in the flat state as shown in FIG. 12 (*a*). As an electric signal in the sinusoidal wave form is imparted on the piezo-electric element 10, the piezo-electric element 10 is sinuously vibrated backward, as shown in FIG. 12 (*b*), thereby sucking ink into the ink sump 20, particularly in the vicinity of the recess 24.

Thereafter, the sheet 13 sinuously vibrates toward the ink layer 16 side, as shown in FIG. 12 (*c*), and due to this bulging action, the ink in the neighborhood of the sheet 13 is bifurcated into the flow tending to go toward the orifice 17 and the flow tending to diffuse in the direction at a right angle thereto. The latter flow, however, is checked from its diffusion due to the presence of the peripheral surface of the recess 24; then, this ink goes toward the orifice 17 side, where the resistance to fluid is low, as shown by arrows in FIG. 12 (*c*). As a result, the ink droplets projection becomes more effective.

In the structure of FIG. 11, ink behaves nearly the same way as in the former one, and it is advantageous in that besides the smoothness with which the ink flow is guided, the forming work for the recess 24 is easy.

What is described in the following is a structure having the pressure cell 11 and the ink sump 20 communicated, or using ink as the pressure transmitting medium filled in the pressure cell 11; the ink passage 25 which communicates the ink in the pressure cell 11 with the ink in the ink sump 20, that is, the ink layer 16, may be formed in any place other than the passive vibrating means or the sheet 13, or it may be formed through the passive vibrating means of the sheet 13.

Figure 13:
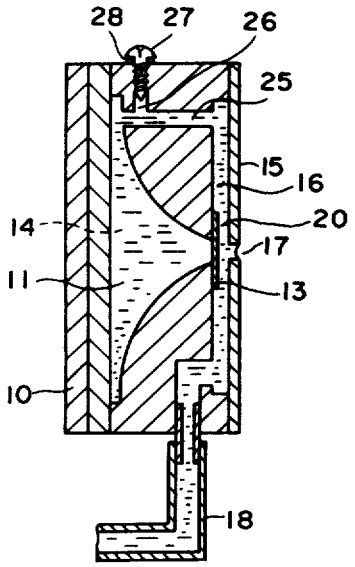
FIGS. 13 and 14 are longitudinal sectional views of embodiments in each of which an ink passage is provided.
Figure 14:
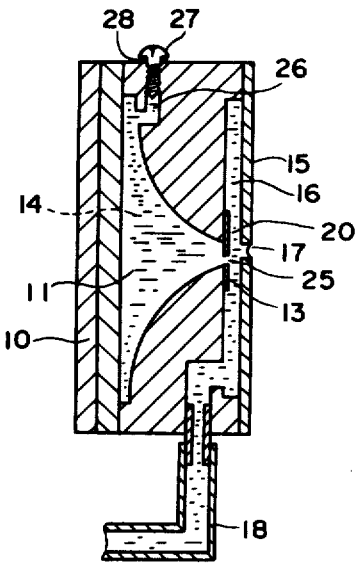

First, the reason why such an ink passage 25 is formed is described. When the sheet 13 is attached after the transmission medium 14 is filled in the pressure cell 11, no problem arises. However, as an industrially preferable method, first, the opening of the pressure cell 11 is closed by attaching the sheet 13, and then, the transmission medium 14 is filled in. In this instance, as shown in FIGS. 13 and 14, an opening is formed at the top of the main body 19 to provide a medium filling port 26 communicating to peripheral part of the pressure cell 11; then, the transmission medium 14 is filled in the pressure cell 11 through this medium filling port 26 while evacuating air therefrom, and thereafter, the medium filling port 26 is closed by means of a screw plug 27 and a packing ring 28. If, unlike the structures shown in FIGS. 13 and 14, a structure having the pressure cell 11 and the ink sump 20 not communicated with each other is utilized, and if the screw plug 27 is excessively screwed in, the sheet 13 will be pushed forward to be bulged to the orifice side. Then, even if the piezo-electric element 10 vibrates in response to the electric signal, the sheet 13 cannot vibrate with a good response. As a result, the ink droplets projection cannot be held. Such a problem, however, has been eliminated by using a structure of communicating the pressure cell 11 with the ink sump 20 through the ink passage 25, as shown in FIGS. 13 and 14. Thus even if the screwing-in of the screw plug 27 is excessively made, the only effect is that an equal pressure is imposed on both sides of the sheet 13, and such a phenomenon as the sheet 13 bulging while absence of the electric signal to be imposed on the piezo-electric element 10 will not take place.

In the embodiment shown in FIG. 13, an ink passage 25 connecting the respective peripheries of the pressure cell 11 and the ink sump 20 is formed at the top of the main body 19, and the ink filling port 26 is communicated to this ink passage 25. However, providing such an ink passage 25, must not induce the undermentioned difficulty. Thus, the pressure change which occurs when the piezo-electric element 10 is vibrated by giving it an electric signal leaks into the ink sump 20 through the ink passage 25, and the vibration of the sheet 13 is affected as the result. Such an event must not be allowed to take place. That is to say, the ink passage 25 should be able to keep the pressure of ink equal in both the pressure cell and the ink layer 16 when ink is not projected, or when the ink filling port is closed with a screw plug after ink filling as hereabove described, but it should never substantially hinder the vibration of the sheet 13 when the piezo-electric element 10 is vibrated.

If, as shown in FIG. 13, the diameter of the ink passage 25 is the order of 200–500 μm when forming the ink passage 25 at the top of the main body 19, it may be formed larger as compared with the aperture, if bored in the sheet 13 as described later. The reason why the diameter of the ink passage 25 can be set relatively large in the device of the embodiment of FIG. 13 is because, while to the sheet 13 attached to the small diameter part, the pressure produced by the vibration of the piezo-electric element 10 is applied after being amplified, to the ink passage 25, the pressure produced by the piezo-electric element 10 is transmitted as it is, and because this pressure is small, being produced at the peripheral part of the piezo-electric element.

In the device of the embodiment shown in FIG. 14, the ink passage 25 is directly bored in the sheet 13 or the passive vibrating means. What is important also in this embodiment is that similarly as hereabove described, the ink passage 25 should be able to make the pressure of ink equal both in the pressure cell and in the ink layer 16 when ink is not projected, and it should not substantially hinder the vibration of the sheet 13 when the piezo-electric element 10 is vibrated. This should be the very point or the distinctive feature of this embodiment which clearly differentiates it from the prior art double cavity type. That both the pressure cell 11 and the ink sump 20 are filled with ink, that a hole is opened in the sheet 13 which partitions the pressure cell 11 from the ink sump 20, etc., show a seemingly analogous structure to that of the conventional device of the double cavity type. But the diaphragm 98 shown in FIG. 21 which never substantially vibrates must be said to be markedly distinguishable from the sheet 13 which vibrates itself, thus directly contributing to the ink droplet projection in spite of the ink passage 25 bored therein.

Figure 15:
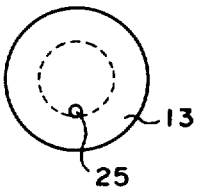
FIGS. 15 and 16 are front views of the sheet 13 of the type used in the embodiment shown in FIG. 14.
Figure 16:
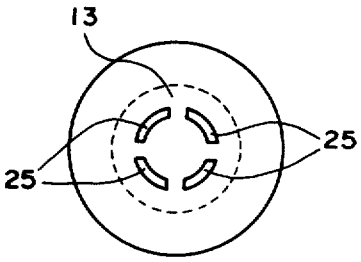

FIGS. 15 and 16 give two configurations of the ink passage 25 opened through the sheet 13, that of FIG. 15 being a round aperture opened as the ink passage 25 at a periphery of the actually vibrating part of the sheet 13 or the rim of the opening 12 of the pressure cell 11, and that of FIG. 16 being four arcuate slits arranged in each quadrant as the ink passage 25, both providing the same effect.

In order that these ink passages 25 can satisfy the conditions of making the ink pressure equal on both sides of the sheet when ink is not projected, and making the sheet 13 vibrate devotedly in response to vibration of the piezo-electric element 10, thus without affecting its vibration when ink is to be projected, the sectional area and the position of the ink passage 25 should be selected carefully. In the example of FIG. 15, the desirable ink droplet projection was realized when the ink passage of 30–70 μm is opened through the sheet with d=2 mm.

Since, the nearer the ink passage is located to the periphery of the substantial vibrating part, the larger its selectable diameter becomes, and the vibration is less affected, the ink passage should desirably be located at the periphery of the said part as hereabove-described, and the central portion directly facing the orifice needs to be precluded. If the ink passage is located at the center so that the ink passage 25 and the orifice 17 are aligned, the pressure transmitted through the ink inside the pressure cell 11 works its way through the ink passage and, then, the orifice to the outside, the ink column thereby jetting out with the similar movement of ink as in the prior art device. In that condition, the vibration of the sheet 13 is no doubt greatly weakened, and moreover because, unlike the diaphragm 98, the sheet 13 is not rigid, the projecting velocity of the ink column is attenuated, detracting from formation of proper ink dots. On this ground, and taking account of the accuracy and workability in attaching the sheet 13 in place, the ink passage 25 should preferably be located outside the circle having a radius of one half as large as the radius of the circle (the dotted line in FIGS. 15 and 16) representing the substantial vibrating part of the sheet 13.

Figure 17:
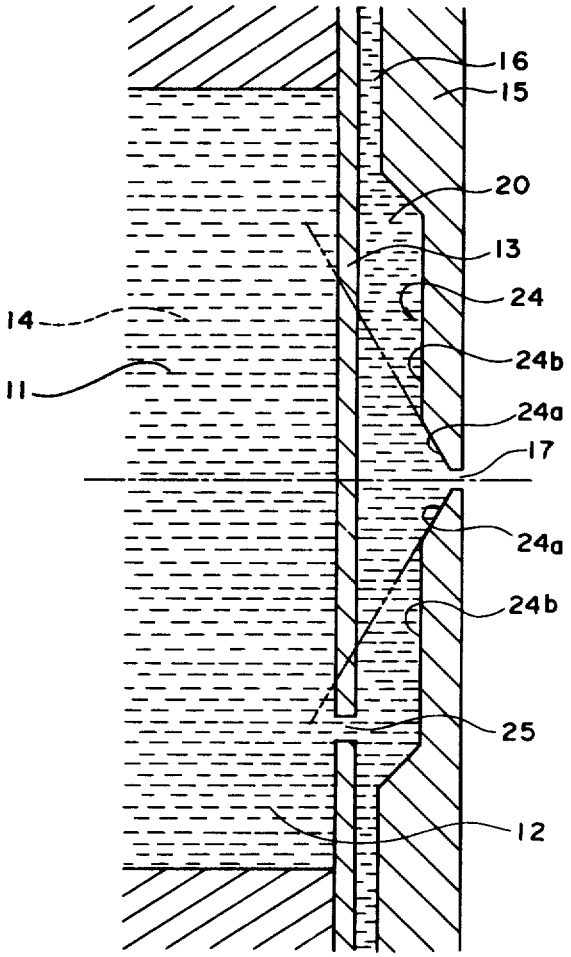
FIG. 17 is an enlarged sectional view of an embodiment in which the ink passage and the recess are formed.

FIG. 17 is an enlarged longitudinal sectional view of an embodiment in which the ink passage 25 is formed through the sheet 13, and a recess 24 is formed around the orifice 17 of the front plate 15. The recess 24 in this embodiment is formed of a small conical part **24*a* contiguous to the orifice 17 and a large tray part 24*b* having an inclined peripheral surface having decreasing diameters toward the orifice side. The diameter of the opening of the larger diameter side of the tray part 24*b* is a little shorter than the diameter of the opening 12 of the pressure cell 11. While the angle of the surface of the conical part 24*a* to the central line of the orifice (represented in the figure by a dotted broken line) should be selected at 30–60 degrees as hereabove described, the ink passage 25 needs to be positioned outward of the circle line which is defined as the intersection of the extended surface of the conical part 24*a* (indicated on the figure by double-dotted broken lines) and the sheet 13. In this structure, the very small flow of ink leaking out through the ink passage 25 by the pressure transmitted through the transmission medium (ink) 14 inside the pressure cell 11 will not interfere with the ink flowing through the conical part 24*a* toward the orifice due to the vibration of the sheet 13; in other words, the ink coming through the ink passage 25 does not affect the vibration of the sheet 13** except for the aforementioned leakage.

Figure 18:
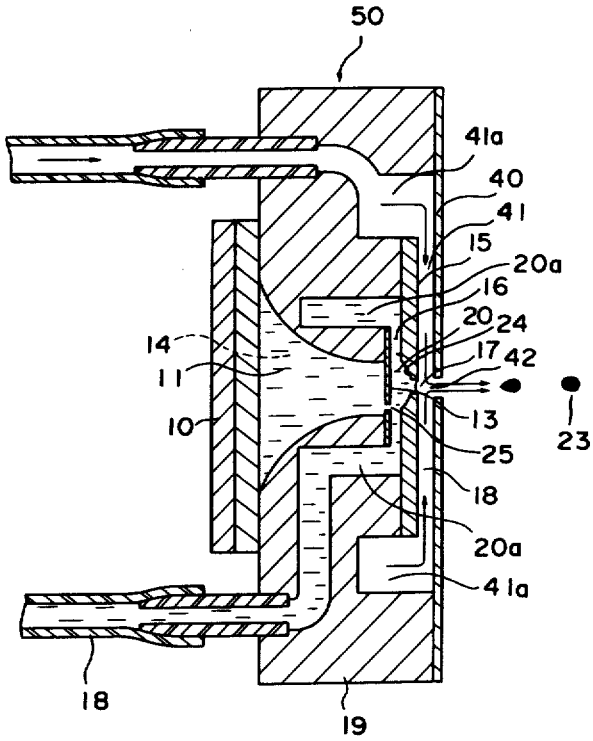
FIG. 18 is a longitudinal sectional view of an embodiment in which an air flowing compartment is provided.
Figure 19:
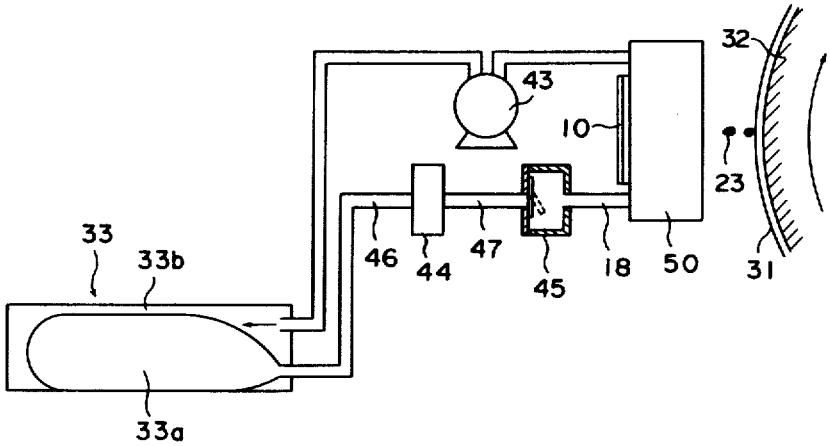
FIG. 19 is a diagrammatic representation of an ink jet printer in which the ink head shown in FIG. 18 is utilized.
Figure 20:
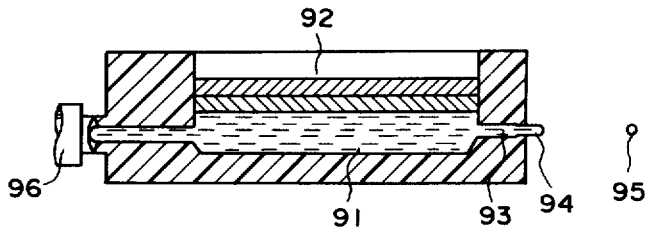
FIG. 20 is a longitudinal sectional view of an ink head of the conventional single cavity type.

FIG. 18 exhibits another embodiment of this invention in which an improvement in the recording quality with ink dots is enabled by accelerating by means of an air flow the projection of the ink droplets through the orifice 17, and FIG. 19 is a schematic diagram of an ink jet printer employing the ink head of this embodiment. The device of this embodiment is provided with all of the hereabove described parts, i.e., the groove **20*a* of the ink sump 20, the conical recess 24 on the periphery of the orifice 17 on the inside surface of the front plate 15, and the ink passage 25 bored in the periphery of the substantial vibrating part of the sheet 13. The distinctive features of this embodiment consist in that a covering plate 40 is arranged in front of the front plate 15, to form an air flowing cell 41 between it and the front plate 15, and at the central part of the covering plate 40, an ink droplet passing hole 42 is located opposite the orifice 17, so that the air fed into the air flowing cell 41 is discharged through the ink droplet passing hole 42 as its exhaust port, thereby accelerating the ink droplets 23 projected from the orifice 17 by means of the discharging air. In order to form the air flowing cell 41, the peripheral part of the main body 19 is a little projected. Inside this projected part, a groove 41*a* which forms a part of the air flowing cell 41 is formed in a ring shape, and at a part of this groove 41*a*, a hole opening at the rear of the main body 19 is formed and being connected with the air outlet of an air pump 43. The cover plate 40 is placed on the front surface of the aforementioned protruded part of the main body 19. The ink droplet passing hole 42 is designed to have a properly large diameter, as compared with that of the orifice 17**. Both holes should be aligned at their centers, but some disagreement may be permissible.

Referring to FIG. 19, 33 denotes a replaceable ink cartridge, and the bag **33*a* containing ink is communicated to the ink sump 20 and the pressure cell 11 through the capillery tubes 46, 47 and 18 with a filter 44 and a check valve 45 interposed therebetween. Into the box 33*b* housing the bag 33*a*, air is fed from an air pump 43, so that the pressure inside the box 33*b* is made a little higher than the atmospheric pressure, thereby a little compressing the bag 33*b*. This ink cartridge 33 is located at a lower level than the ink head of the structure as shown in FIG. 18. The check valve 45 is so constructed as to permit the ink flow toward the ink head 50 side, but prohibit its flow toward the cartridge 33** side.

In the ink jet printer of the structure as hereabove described, the air pump 43 is driven only during the recording time. Accordingly, the ink in the bag **33*a* has a negative pressure to the ink in the ink sump 20 during the down time, because the ink cartridge is placed at a lower level than the ink head 50, and the check valve 45 closes without fail. Then the ink staying between the ink head 50 and the check valve 45 can be held in equilibrium as the check valve 45 is closed, so that no infiltration of air through the orifice 17** will take place.

As the recording operation begins with the air pump 43 driving, by the vibration of the sheet 13, the ink in the ink layer 16 is ejected through the orifice 17; then, accelerated by the air, fed by the air pump 43, arriving in the air flowing cell 41, and then being discharged through the ink droplet passing hole 42, the ink droplets 23 fly to the recording medium 31 wound on the rotary drum 32, forming ink dots thereon. With the increasing consumption of the ink layer 16 in the ink sump 20, the ink pressure drops below the ink pressure inside the bag **33*a* which has been raised by the supply of air by the air pump 43. Then the check valve 45 is opened and ink is replenished, to replenish ink to the ink sump 20 so far as the negative pressure thereto is cancelled. In that way, the ink droplet projection is continued on being carried out without run-out of ink supply or air infiltration into the ink layer 16**.

As described hereabove, the device of this invention is of a structure such that the passive vibrating means is vibrated by the pressures produced by the vibrations of the pressure generating means (which is not limited to the unimorphic type piezo-electric element above-mentioned, but may include either piezo-electric element of the bimorphic type or other vibrating means which make use of the Lorentz force), and by the action of this vibration, the object ink is projected. Such a structure is easy to set up, and achieves the effects of making the projection characteristic uniform and markedly reducing the possibility of sucking in air.

What is claimed is:

1. An ink droplet projecting device comprising:
   - a pressure generating means which vibrates in response to an electric signal;
   - a pressure cell, a part of the side wall thereof being composed of said pressure generating means and a passive vibrating means which has a smaller area than that of the pressure generating means;
   - transmission medium filled in said pressure cell to transmit the vibration of the pressure generating means to the passive vibrating means; and
   - a means for holding an ink layer on the passive vibrating means on the exterior side of said pressure cell;
   - whereby the pressure generated by the vibration of the pressure generating means is concentrically given to the passive vibrating means through the transmission medium, the passive vibrating means vibrates thereby, and by this vibration, each ink droplet is projected from the ink layer.

2. A ink droplet projecting device as specified in claim 1, wherein said pressure generating means is a piezo-electric element.

3. An ink droplet projecting device as specified in claim 1 wherein said pressure generating means and said passive vibrating means are arranged face to face.

4. An ink droplet projecting device as specified in claim 1 or 3, wherein said pressure cell is in the shape of a horn having diminishing diameters from the side where the pressure generating means is placed toward the side where the passive vibrating means is located.

5. An ink droplet projecting device as specified in claim 1, 2, or 3, wherein a front plate is provided to hold the ink layer between itself and said passive vibrating means, with an orifice for projecting ink droplet, bored at the position facing the passive vibrating means.

6. An ink droplet projecting device as specified in claim 5, wherein said front plate has a recess formed on the ink layer side surface thereof and on the perimeter of the orifice bored therein.

7. An ink droplet projecting device as specified in claim 6, wherein said recess is in a conical shape.

8. An ink droplet projecting device as specified in claim 5, wherein the substantial opening bore of said orifice is 40–60 μm, and the diameter of the substantial vibrating part of the passive vibrating means and its thickness are 1–3 mm, and 30–80 μm respectively.

9. An ink droplet projecting device as specified in claim 5, wherein a covering plate being disposed with a suitable distance from the outer surface of said front plate, and having an ink droplet passing hole bored at a position facing said orifice, is provided, so that air is passed through the gap formed between the front plate and the covering plate, with the ink droplet passing hole at the exhaust port.

10. An ink droplet projecting device as specified in claim 1, 6, or 9, wherein said pressure cell is filled with ink as the transmission medium, and an ink passage(s) for communicating the ink in the pressure cell to said ink layer is(are) formed, said ink passage(s) having such a sectional area that the ink flow therethrough will not substantially impede the vibration of the passive vibrating means for projecting the ink droplet, but that the ink pressures in the pressure cell and in the ink layer are equalized when ink droplet is not projected.

11. An ink droplet projecting device as specified in claim 10, wherein said ink passage(s) is(are) formed in any place other than the passive vibrating means.

12. An ink droplet projecting device as specified in claim 10, wherein said ink passage(s) is(are) formed in the passive vibrating means.

13. An ink droplet projecting device as specified in claim 5, wherein said pressure cell is filled with ink as the transmission medium, and an ink passage(s) for communicating the ink in the pressure cell to said ink layer is(are) formed, said ink passage(s) having such a sectional area that the ink flow therethrough will not substantially impede the vibration of the passive vibrating means for projecting the ink droplet, but that the ink pressure in the pressure cell and in the ink layer are equalized when ink droplet is not projected.

14. An ink droplet projecting device as specified in claim 13, wherein said ink passage(s) is(are) formed in any place other than the passive vibrating means.

15. An ink droplet projecting device as specified in claim 13, wherein said ink passage(s) is(are) formed in the passive vibrating means.

16. An ink droplet projecting device as specified in claim 12 or 15, wherein said ink passage(s) is(are) formed on the periphery of the passive vibrating means.

17. An ink droplet projecting device as specified in claim 12 or 15, wherein said ink passage(s) is(are) formed in the passive vibrating means at a position(s) not directly facing said orifice.

18. An ink jet printer including an ink droplet projecting device comprising:
   - a pressure generating means which vibrates in response to an electric signal;
   - a pressure cell, a part of the side wall thereof being composed of said pressure generating means and a passive vibrating means which has a smaller area than that of the pressure generating means;
   - transmission medium filled in said pressure cell to transmit the vibration of the pressure generating means to the passive vibrating means; and
   - means for holding an ink layer on the passive vibrating means on the exterior side of said pressure cell;
   - whereby the pressure generated by the vibration of the pressure generating means is concentrically given to the passive vibrating means through the transmission medium, the passive vibrating means vibrates thereby, and by this vibration, the ink droplet is projected from the ink layer.

19. An ink jet printer as specified in claim 18, wherein there are provided a front plate which holds the ink layer between itself and said passive vibrating means, and which has an orifice for projecting ink, bored at the position facing the passive vibrating means, a covering plate being disposed with a suitable distance from the outer surface of said front plate, and having an ink droplet passing hole bored at the position facing said orifice, and the means for feeding air through the gap formed between the front plate and the covering plate, with the ink droplet passing hole as the exhaust port.

* * * * *